United States Patent [19]

Nakajima et al.

[11] Patent Number: 5,052,477

[45] Date of Patent: Oct. 1, 1991

[54] PIPE FOR COOLANT CONDENSER

[75] Inventors: Ichio Nakajima; Tsuneo Kousaka; Noboru Okada, all of Isezaki, Japan

[73] Assignee: Yuugen Kaisha Marunaka Seisakusho, Gunma, Japan

[21] Appl. No.: 517,356

[22] Filed: May 1, 1990

[30] Foreign Application Priority Data

Sep. 11, 1989 [JP] Japan ..... 1-106343[U]

[51] Int. Cl.[5] ..... E28D 1/02

[52] U.S. Cl. ..... 165/153; 165/173

[58] Field of Search ..... 165/153, 173, 176; 29/890.052

[56] References Cited

U.S. PATENT DOCUMENTS 1,586,984 6/1986 Foster ..... 29/890.052

4,825,941 5/1989 Hoshino et al. ..... 165/153

*Primary Examiner*—Ronald C. Capossela

*Attorney, Agent, or Firm*—Bauer & Schaffer

[57] ABSTRACT

A plurality of short pipe body sections can be coupled to one another with a coupling which has cylindrical contact about the inner and/or outer surfaces of the pipes to obtain a pipe having a desired length. The coupling also serves as a partitioning plate to block flow of coolant through pipe.

8 Claims, 3 Drawing Sheets

PIPE FOR COOLANT CONDENSER

FIELD OF THE INVENTION

This invention relates to the construction of header pipes for coolant condensers used for automobile air conditioners.

PRIOR ART

The conventional coolant condenser has a construction as shown in FIGS. 5 and 6, where coolant is fed from the left header pipe A to an upper set of three heat exchange tubes B and thence to the right header pipe C, and from pipe C it is returned through an intermediate lower set of three heat exchange tubes B to pipe A to be ultimately discharged through a lower set of three tubes B to pipe C. The coolant condenser pressurizes coolant flowing in such meandering or sinuous fashion as to cause forced heat radiation and render the coolant into cooled liquid at low temperature and under high pressure. Heat radiated at this time is transferred from tubes B to corrugated fins D provided between adjacent tubes B to be dissipated by air moved through the fins D.

The header pipes A and C have identical structure, each pipe consisting of a cylindrical body F, in which is formed by a stamping operation a plurality of parallel uniformly spaced slots G for receiving the heat exchange tubes B. Partitioning plates E, inserted in slots H, provide for the axial division of the header pipe. The exchange tubes B and the partitioning plates E, inserted into their respective slots, are soldered to the header pipe body F to prevent leakage of the coolant and to fix them in place.

PROBLEMS IN THE PRIOR ART

The slots G and H in the header pipes have been formed by a stamping or press operation leading to the fact that the edges of these slots G and H are likely to be depressed or strained. As a consequence, deformation of the sectional shapes of pipes A and C occurs. When this results, it becomes difficult to insert the partitioning plates E, particularly since they are thin. Also, a gap is formed between each edge of the partitioning plates E and inner periphery (i.e. wall) of the header pipe. Frequently, the soldering application fails to perfectly close the gap, thus leading to a problem of leakage of coolant through the gap.

To solve this problem, it had been proposed, as seen in FIG. 8, to couple two pipes J axially with a partitioning plate E interposed between the two pipes J. In this case, however, the positioning of the two pipes J to be coupled is difficult, and the pipes, once positioned, may easily be deviated from the axis before soldering. Furthermore, the soldered areas between the partitioning plate E and pipe J corresponds to only the thickness of the coupled end surface K (i.e. the wall of pipes J). Therefore, the mechanical strength of soldering is very low, and the resultant header pipe is liable to breakage at the point of soldering.

OBJECT OF THE INVENTION

An object of the present invention is to provide a header pipe for a coolant condenser, which has its interior perfectly partitioned, is free from leakage of coolant, and has excellent coolant condensation.

SUMMARY OF THE INVENTION

According to the present invention, there is provide a header pipe for a coolant condenser, which, as shown in FIGS. 1–4, comprises two or more pipe bodies 1, each having insertion slots F and coupling/partitioning members 2. The coupling/partitioning members 2 are interposed between two adjacent bodies 1 and secure these bodies end to end. Each coupling member 2 has a cylindrical portion 3, which abuts and supports the two bodies 1 along their inner surfaces 1*a* or their outer surfaces 1*b*, and a solid portion 4 partitioning the interiors of the two bodies 1 to occlude passage therethrough.

DETAILED DESCRIPTION OF THE INVENTION

Figure 1:
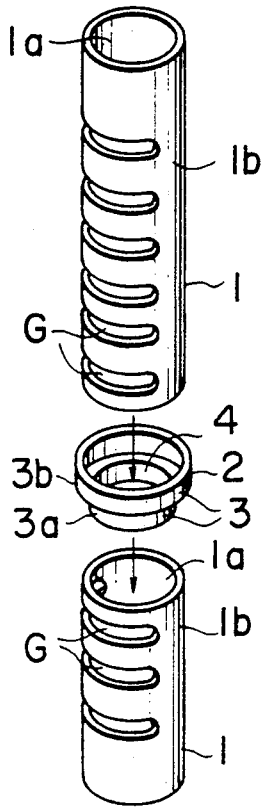
FIG. 1 is a perspective view showing a header pipe for a coolant condenser embodying the present invention.
Figure 2:
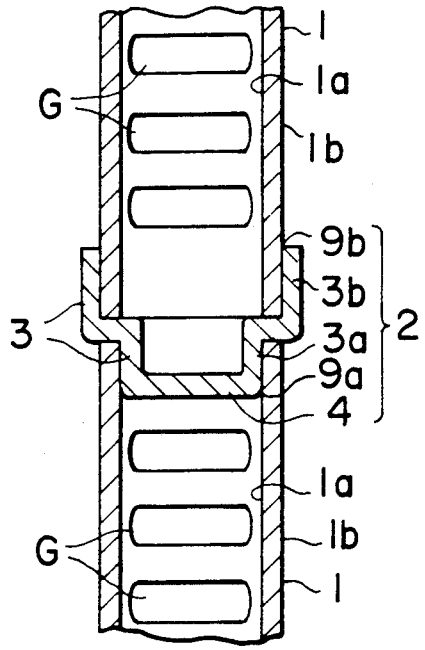
FIG. 2 is a sectional view of the header pipe of FIG. 1.

Referring to the FIGS. 1 and 2, reference number 1 designates a pipe body section having insertion slots G for receiving the heat exchange tubes B, such as in the prior art.

According to the present invention, a coupling/partitioning member 2 is interposed between two adjacent pipe body sections 1 and 1' to secure together and isolate the pipe bodies. The coupling/partitioning member 2 is formed by pressing or stamping a highly ductile plate, or sheet (for instance, an aluminum plate) into a cylindrical support portion 3 and a solid partitioning portion 4. The cylindrical support portion 3, as shown in FIG. 2, has an outer support 3*b* in which one pipe body section is seated and which abuts the outer peripheral wall lb of the pipe body 1 and an inner support 3*a* which seats within the other pipe body 1' and engages the inner peripheral wall 1*a* thereof.

The inner diameter of outer support 3*b* and outer diameter of the one pipe body 1 and also outer diameter of inner support portion 3*a* and inner diameter of the other pipe body 1' are formed such that the mating parts snugly fit each other. With this arrangement, two pipe bodies 1 and 1' can be positioned axially relative to each other by merely fitting the coupling/partitioning member 2 to the ends of each of the two pipe bodies 1 and 1' to form a complete header pipe in which the partitioning portion 4 is securely mounted between the two bodies to occlude the passage from one to the other.

To facilitate fitting of the two pipe bodies 1 and 1', the outer support 3*b* 3 flares slightly to form an inlet socket 9*b* (FIG. 2), while the inner support portion 3*a* tapers to form a plug-like tapering insertion end 9*a*.

The partitioning portion 4 serves to divide the interior passage in the coupled bodies 1 and 1', and, as shown in FIG. 2, it forms the bottom of the support portion 3. While the illustrated partitioning portion 4 is flat, it need not be so; for instance, it is possible to provide a partitioning portion, which spherically projects in the direction of flow of coolant or may have other shapes.

Figure 3:
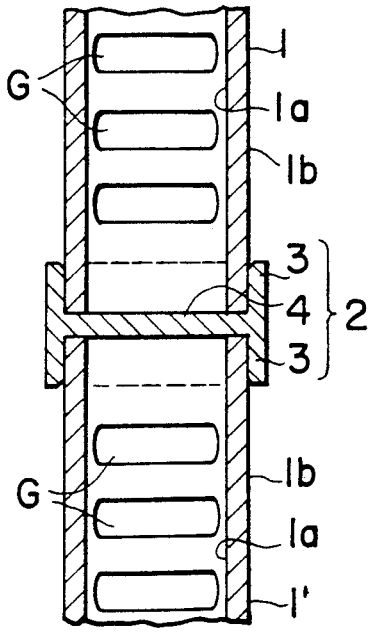
FIGS. 3 and 4 are sectional views showing different embodiments of the invention.

FIG. 3 shows another embodiment in which coupling/partitioning member 2 has an H-shaped sectional profile, which is easily formed from a thick plate by stamping. In this case, the actual supports 3*a* and 3*b* engage the respective pipe bodies 1 and 1′ about their outer peripheral wall surfaces 1*a* and 1*b*, respectively.

Figure 4:
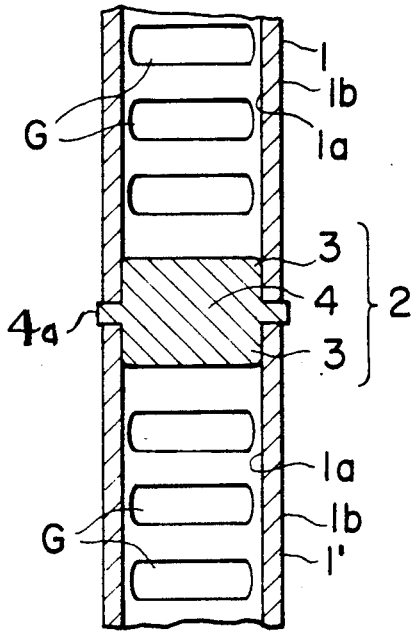
Figure 5:
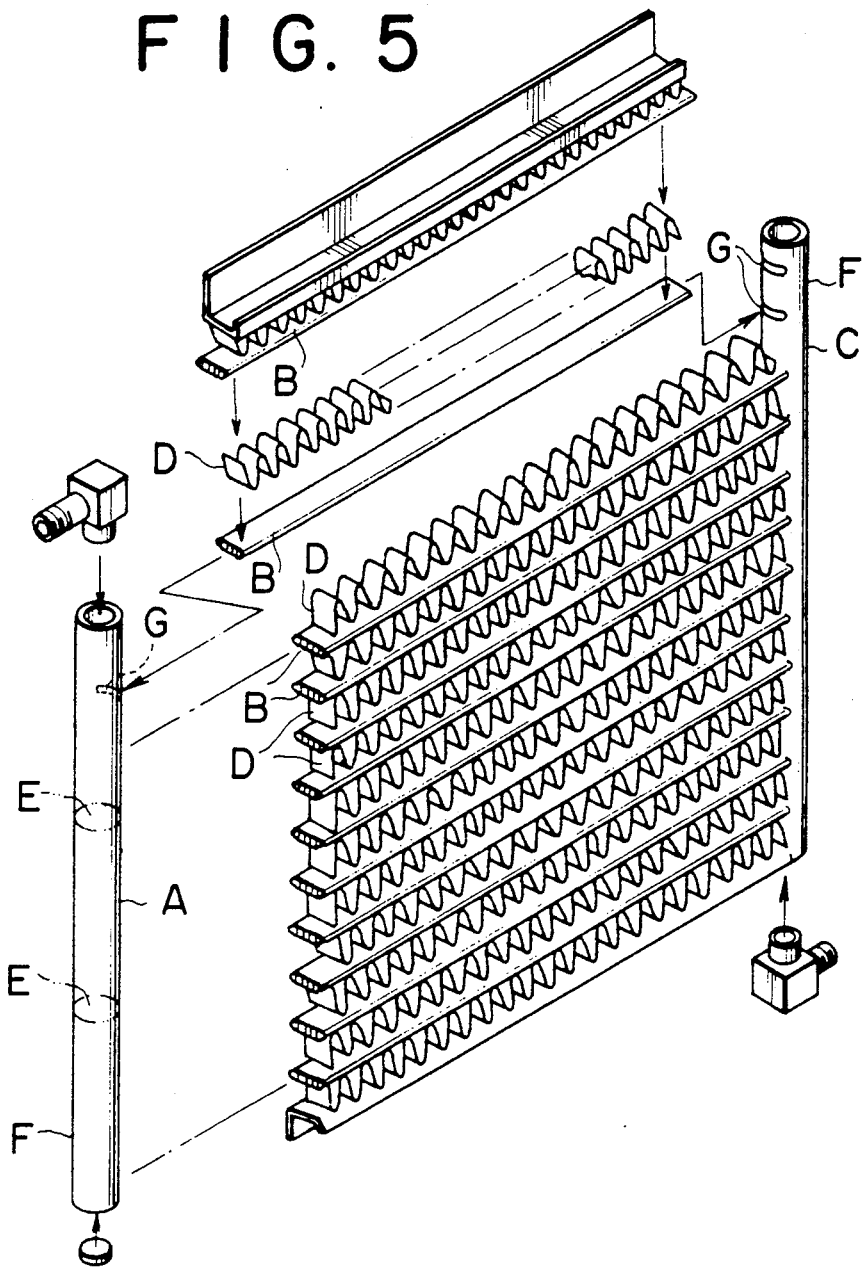
FIG. 5 is a view showing a prior art coolant condenser.
Figure 6:
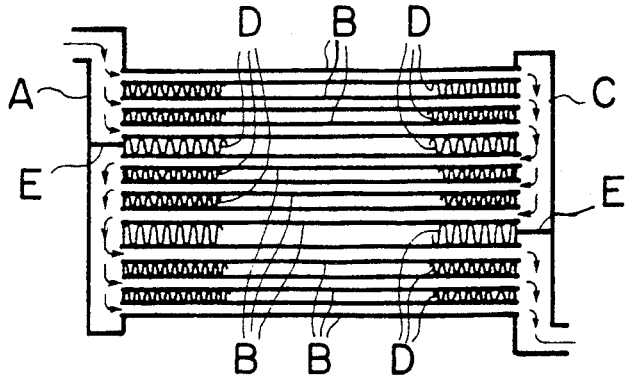
FIG. 6 is a diagrammatic view illustrating the flow of coolant in the condenser of FIG. 5.
Figure 7:
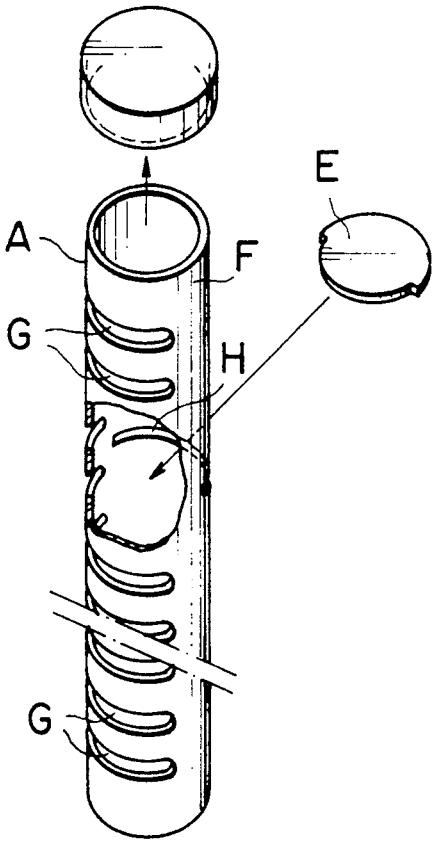
FIGS. 7 and 8 are perspective views showing different prior art coolant condenser header pipes.
Figure 8:
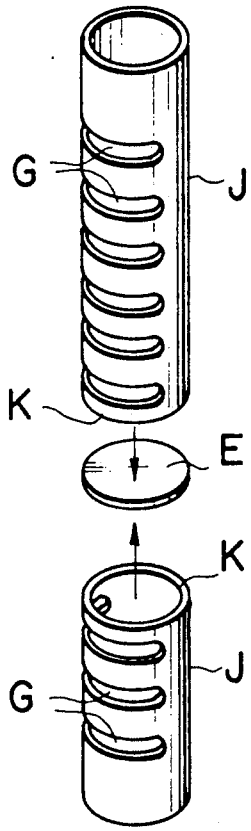

FIG. 4 shows still another embodiment in which the coupling/partitioning member 2 is a solid body formed such that its cylindrical support 3*a* and 3*b* fit in the inner passage of the respective pipe bodies 1 and 1′ and support these pipe bodies along their inner surface la thereof. The partitioning portion 4 is provided with an annular flange 4*a* on which the frontal ends of the respective pipes seat.

USE OF THE INVENTION

A header pipe for a coolant condenser according to the invention enables a pair of pipe bodies to be joined axially by a coupling/partitioning member 2 having support 3 to support the pipe bodies 1 along inner surface 1*a* and/or outer surface 1*b* thereof. Thus, the two pipe portions 1 and 1′ are readily centered axially to each other and cannot be deviated therefrom before soldering.

Since the coupling/partitioning member 2 has a built in inherent partitioning portion 4, the mere coupling of the pipe bodies 1 and 1′ together results in the creation of the partition and seal against leakage which seal has large surface contact with the pipe body sections and which may be securely held together.

ADVANTAGES OF THE INVENTION

1) Two pipe bodies 1 which are to be coupled together can be easily positioned axially relative to each other.

2) No shifting or deviation occurs before soldering.

3) The soldering areas of pipe body 1 and support portion 3 are large enough to obtain firm coupling of two pipe bodies 1 and 1′.

4) By merely coupling together two pipe bodies 1 with coupling/partitioning member 2, two pipe bodies 1 are perfectly partitioned to prevent leakage of coolant.

5) The structure is simple and well suited for practical use.

We claim:

1. In a coolant condenser having a pair of header pipes spanned by a plurality of heat exchange tubes having ends of predetermined length inserted in slots in the header pipes, the improvement wherein said header pipe is formed of at least two tubular body sections axially joined at their ends by a coupling comprising a first cylindrical section and a second cylindrical section integrally formed with an intermediate partition section occluding passage therethrough said first and second cylindrical sections being adapted to securely engage a selected surface of the first and second pipes.

2. The improvement according to claim 1 wherein said first cylindrical section is adapted to engage the exterior surface of one pipe and the second cylindrical section is adapted to engage the inner surface of the other pipe.

3. The improvement according to claim 1, wherein said first cylindrical section and said cylindrical section are adapted to engage the exterior surfaces of each pipe.

4. The improvement according to claim 1, wherein said first cylindrical section and said second cylindrical section are adapted to engage the interior surfaces of each pipe.

5. The improvement according to claim 1, wherein at least one of said cylindrical sections is tapered.

6. The improvement according to claim 1, wherein said coupling is provided with an annular flange adapted to seat between the ends of adjacent pipes.

7. The improvement according to claim 1, wherein said first cylindrical section is cup-shaped and said second cylindrical section comprises a solid plug.

8. The improvement according to claim 1, wherein said plug is H-shaped in cross section.

* * * * *

UNITED STATES PATENT AND TRADEMARK OFFICE

CERTIFICATE OF CORRECTION

PATENT NO. : 5,052,477

DATED : October 1, 1991

INVENTOR(S) : I. Nakajima et al

It is certified that error appears in the above-identified patent and that said Letters Patent is hereby corrected as shown below:

Column 4,

Claim 3, line 2, before "cylindrical" (second occurrence) insert --second--

Signed and Sealed this

Fourteenth Day of June, 1994

Bruce Lehman

*Attest:*

BRUCE LEHMAN

*Attesting Officer*

*Commissioner of Patents and Trademarks*